US005713415A

United States Patent [19]

Bridges

[11] Patent Number: 5,713,415

[45] Date of Patent: Feb. 3, 1998

[54] LOW FLUX LEAKAGE CABLES AND CABLE TERMINATIONS FOR A.C. ELECTRICAL HEATING OF OIL DEPOSITS

[75] Inventor: Jack E. Bridges, Park Ridge, Ill.

[73] Assignee: Uentech Corporation

[21] Appl. No.: 685,512

[22] Filed: Jul. 24, 1996

Related U.S. Application Data

[63] Continuation of Ser. No. 397,440, Mar. 1, 1995, abandoned.

[51] Int. Cl.[6] ..... E21B 43/24

[52] U.S. Cl. ..... 166/60; 166/65.1

[58] Field of Search ..... 166/60, 248, 65.1; 392/301

[56] References Cited

U.S. PATENT DOCUMENTS

| | | | |
|---|---|---|---|
| 3,141,099 | 7/1964 | Brandon | 166/248 X |
| 3,149,672 | 9/1964 | Orkiszewski et al. | 166/248 |
| 3,620,300 | 11/1971 | Crowson | 166/60 X |
| 4,008,761 | 2/1977 | Fisher et al. | 166/248 |
| 4,279,299 | 7/1981 | Shuck | 166/60 |
| 4,463,805 | 8/1984 | Bingham | 166/248 |
| 4,524,827 | 6/1985 | Bridges et al. | 166/248 |
| 4,919,201 | 4/1990 | Bridges et al. | 166/60 |
| 5,070,533 | 12/1991 | Bridges et al. | 166/60 X |

*Primary Examiner*—Hoang C. Dang
*Attorney, Agent, or Firm*—Dorn, McEachran, Jambor & Keating

[57] ABSTRACT

Low-flux-leakage cables and cable terminations for an A.C. electrical heating system that heats a fluid reservoir around a mineral fluid well, usually an oil well; the system utilizes A.C. electrical heating power in a range of 25 to 1000 Hz. The well has a borehole extending down through overburden formations and through a subterranean fluid reservoir; the well includes an electrically conductive upper casing in the overburden, an electrically conductive heating electrode located in the reservoir, and an electrically insulating casing between the upper casing and the heating electrode. The cable extends down through the upper casing and is connected to the heating electrode to supply electrical power to the electrode. The power cable has two or three electrical conductors which are electrically isolated from each other, enclosed within a steel sheath. The conductors are electrically terminated within a zone that immediately surrounds the heating electrode and adjacent formations; there is a net vertical current of approximately zero in the conductors so that eddy current and skin effect losses in the steel sheath are minimized. For a two-conductor cable, one conductor is connected to the well casing and the other is connected to the electrode.

6 Claims, 7 Drawing Sheets

LOW FLUX LEAKAGE CABLES AND CABLE TERMINATIONS FOR A.C. ELECTRICAL HEATING OF OIL DEPOSITS

This patent application is a continuation of application Ser. No. 08/397,440, filed Mar. 1, 1995, now abandoned.

BACKGROUND OF THE INVENTION

Major problems exist in producing oil from heavy oil reservoirs due to the high viscosity of the oil. Because of this high viscosity, a high pressure gradient builds up around the well bore, often utilizing almost two-thirds of the reservoir pressure in the immediate vicinity of the well bore. Furthermore, as the heavy oils progress inwardly to the well bore, gas in solution evolves more rapidly into the well bore. Since gas dissolved in oil reduces its viscosity, this further increases the viscosity of the oil in the immediate vicinity of the well bore. Such viscosity effects, especially near the well bore, impede production; the resulting wasteful use of reservoir pressure can reduce the overall primary recovery from such reservoirs.

Similarly, in light oil deposits, dissolved paraffin in the oil tends to accumulate around the well bore, particularly in screens and perforations and in the deposit within a few feet from the well bore. This precipitation effect is also caused by the evolution of gases and volatiles as the oil progresses into the vicinity of the well bore, thereby decreasing the solubility of paraffins and causing then to precipitate. Also, the evolution of gases causes an auto-refrigeration effect which reduces the temperature, thereby decreasing solubility of the paraffins. Similar to paraffin, other condensable constituents also plug up, coagulate or precipitate near the well bore. These constituents may include gas hydrates, asphaltenes and sulfur. In certain gas wells, liquid distillates can accumulate in the immediate vicinity of the well bore, which also reduces the relative permeability and causes a similar impediment to flow. In such cases, accumulations near the well bore reduce the production rate and reduce the ultimate primary recovery.

Electrical resistance heating has been employed to heat the reservoir in the immediate vicinity of the well bore. Basic systems are described in Bridges U.S. Pat. No. 4,524,827 and in Bridges et al. U.S. Pat. No. 4,821,798. Tests employing systems similar to those described in the aforementioned patents have demonstrated flow increases in the range of 200% to 400%.

A major engineering difficulty is to design a system such that electrical power can be delivered reliably, efficiently, and economically down hole to heat the reservoir. Various proposals over the years have been made to use electrical energy in a power frequency band such as DC or 60 Hz AC, or in the short wave band ranging from 100 kHz to 100 MHz, or in the microwave band using frequencies ranging from 900 MHz to 10 GHz. Various down hole electrical applicators have been suggested; these may be classified as monopoles, dipoles, or arrays of antennas. A monopole is defined as a vertical electrode whose size is somewhat smaller than the thickness (depth) of the deposit; the return electrode is usually large and placed at a distance remote from the deposit. For a dipole, two vertical electrodes are used and the combined extent is smaller than the thickness of the deposit. These electrodes are excited with a voltage applied to one with respect to the other.

Where heating above the vaporization point of water is not needed, use of frequencies significantly above the power frequency band is not advisable. Most typical deposits are moist and rather highly conducting; high conductivity increases the lossiness of the deposits and restricts the depth of penetration for frequencies significantly above the power frequency band. Furthermore, use of frequencies above the power frequency band may also require the use of expensive radio frequency power sources and coaxial cable or waveguide power delivery systems.

An example of a power delivery system employing DC to energize a monopole is given in Bergh U.S. Pat. No. 3,878,312. A DC source supplies power to a cable which penetrates the wellhead and which is attached to the production tubing. The cable conductor ultimately energizes an exposed electrode in the deposit. Power is injected into the deposit and presumably returns to an electrode near the surface of the deposit in the general vicinity of the oil field. The major difficulty with this approach is the electrolytic corrosion effects associated with the use of direct current.

Hugh Gill, in an article entitled, "The Electro-Thermic System for Enhancing Oil Recovery," in the Journal of Microwave Power, 1983, described a different concept of applying power to an exposed monopole-type electrode in the pay zone of a heavy oil reservoir. In his FIG. 1 Gill shows a schematic diagram wherein electrically isolated production tubing replaces the electrical cable used in the Bergh patent. The current flows from the energizing source down the production tubing to the electrode, and then returns to an electrode near the surface to complete the electrical circuit. The major difficulty with this involves two problems. First, the production casing of the well surrounds the current flowing on the tubing. In such instances, the current itself produces a circumferential magnetic field intensity which causes a large circumferential magnetic flux density in the steel well casing. Under conditions of reasonable current flow to the electrode this high flux density causes eddy appreciable current and hysteresis losses in the casing. Such losses can absorb most of the power intended to be delivered down hole into the reservoir. The second major problem is associated with the skin effect losses in the production tubing itself. While the DC resistance of the tubing is small, the AC resistance can be quite high due to the skin effect phenomena caused by the circumferential magnetic field intensity. This generates a flux and causes eddy currents to flow. The eddy currents cause the current to flow largely on the skin of the production tubing, thereby significantly increasing its effective resistance. Such problems are minimal in the system of the Bergh patent, wherein the DC current avoids the problems associated with eddy currents and hysteresis losses.

Another method to partially mitigate the hysteresis losses in the production casing is described by William G. Gill in U.S. Pat. No. 3,547,193. In this instance the production tubing, typically made from steel, is used as one conductor to carry current to an exposed monopole electrode located in the pay zone of the deposit. Current flows outwardly from the electrode and then is collected by the much larger well casing. As implied in this patent, the design is such as to force the current to flow on the inside of the production casing, and thereby reduce by about 50% the eddy currents and hysteresis losses associated with the production casing.

Power delivery systems for implanted dipoles in the deposits have largely employed the use of coaxial cables to deliver the power. For example, in U.S. Pat. No. 4,508,168 by Vernon L. Heeren, a coaxial cable power delivery system is described wherein one element of the dipole is connected to the outer conductor of the coaxial cable and the other to the inner conductor. Heeren suggests the use of steel as a material for the coaxial transmission line which supplies RF energy to the dipole. However, it is more common practice to use copper and aluminum as the conducting material. Unfortunately, both copper and aluminum may be susceptible to excessive corrosion in the hostile atmosphere of an oil well. This produces a dilemma, inasmuch as aluminum and copper cables are much more efficient than steel for power transmission but are more susceptible to corrosion and other types of degradation.

Haagensen, in U.S. Pat. No. 4,620,593, describes another method of employing coaxial cables or waveguides to deliver power to down hole antennas. In this instance, the coaxial cable is attached to the production tubing and results in an eccentric relationship with respect to the concentric location of the pump rod, the production tubing and the production casing. Haagensen's object is to use the coaxial cable as a wave guide to deliver power to antenna radiators embedded in the pay zone of the deposit. However, as stated previously, energy efficient materials for the wave guides or cables are usually formed from copper or aluminum, and these are susceptible to corrosion in the environment of an oil well. The conversion of power frequency AC energy into microwave energy is costly. The cables themselves, when properly designed to withstand the hostile environment of an oil well, are also quite costly. Furthermore, it appears unlikely that the microwave heating will have any significant reach into the oil deposit and the heating effects may be limited to the immediate vicinity of the well bore.

To address some of these difficulties Bridges, et al. U.S. Pat. No. 5,070,533 describes a power delivery system which utilizes an armored cable to deliver AC power from the surface to an exposed monopole electrode. In this case, an armored cable which is commonly used to supply three-phase power to down hole pump motors is used. However, the three phase conductors are conductively tied together and thereby form, in effect, a single conductor. From an above ground source, the power passes through the wellhead and down this cable to energize an electrode imbedded in the pay zone of the deposit. The current then returns to the well casing and flows on the inside surface of the casing back to the surface. The three conductors in the armored cable are copper. The skin effect energy loss associated with using the steel production tubing as the principal conductor is thereby eliminated. However, several difficulties remain. A low frequency source must be utilized to overcome the hysteresis and eddy current losses associated with the return current path through the steel production casing. Furthermore, non-magnetic armor must be used rather than galvanized steel armor. Galvanized steel armor that surrounds the downward current flow paths on the three conductors causes a circumferential magnetic flux in the armor. This circumferential flux can create significant eddy currents and hysteresis losses in the steel armor and may result in excessive heating of the cable. As a consequence, in order to avoid the excessive heating problems and losses, Monel armor is used, which is more expensive than the galvanized steel armor. However, a major benefit of the approach described in Bridges et al. 5,070,533 is that commonly used oil field components are used throughout the system, with the exception of the apparatus in the immediate vicinity of the pay zone. Offsetting these benefits are the high cost of cable using Monel armor that exhibits very small magnetic effects and the need to use a frequency converter which converts 60 Hz AC power to frequencies between 5 Hz and 15 Hz.

Another difficulty with some prior proposals has been the existence of high potentials on substantial portions of equipment at the wellhead. As a consequence, substantial and costly precautions have been required. Additional barriers or grounding elements have been employed, so that personnel in the vicinity of the wellhead cannot come in contact with the exposed energized conductors. Other approaches, such as exemplified by Bridges et al. in U.S. Pat. No. 5,070,533, entail apparatus and equipment which inherently create a "cool" wellhead wherein the energized conductors exist only within an armored insulated cable. For this, the electrical safety precautions are very similar to those associated with apparatus to supply electrical power to down hole electrical pumps.

Statement of the Invention

It is an object of this invention, therefore, to provide a more reliable, economical, efficient and safe method to deliver electrical power, for heating, into the pay zone of the reservoir in a well employed in the production of fluid from a heavy oil or other mineral deposit. In line with this overall object the following specific objects are noted:

- Substantial reduction in hysteresis and eddy current effects in the tubing and casing of a well.
- Suppression of eddy current and hysteresis effects in armor used to surround a power delivery cable within a well bore.
- Effective use of inexpensive armor such as galvanized steel in place of more expensive Monel armor.
- Elimination of a need for expensive power conditioning equipment to convert 60 Hz electrical power to the 5–15 Hz frequency band.
- Effective use of a low cost 60 Hz power source.
- An electrically "cool" wellhead with no significant amount of exposed energized metal.
- Effective use of standard commercially available and widely used oil field equipment and practices.

The above goals are broadly realized by using methods and apparatus which suppress magnetic leakage fields which arise from cables or conductors used to deliver power down hole typically for reservoir heating purposes. The eddy currents and hysteresis losses which arise from high level leakage fields from such cables are suppressed or eliminated. Furthermore, the cost of armored cables is reduced by eliminating the need to have a largely non-magnetic material, such as Monel, to mechanically and chemically protect the cable in the severe down hole oil well environment. The principle associated with suppression of leakage fields is to assure that the net upward and downward current flow through any continuous or nearly continuous loop-like path through any magnetic steel material is nearly zero. Such currents preferably should not flow on the wall surfaces of the well casing or of the production tubing. Limited current flow on the walls of the casing may be acceptable in some cases.

A key feature of the equipment design is the way in which power cables enter into the wellhead and the way in which they are connected down hole to a heating electrode. If such connections are not properly treated, the net current flow criteria previously discussed may not be realized either partially or completely. Assuming just one downhole heating electrode, it is important that one of the conductors carrying current down hole be connected to the casing immediately above the reservoir and that the other conductor be connected to the heating electrode which penetrates into the reservoir. The connections to the cable connector at the wellhead should be fed from a transformer secondary which ideally is ungrounded. This insures that all current flow is on the copper or aluminum wires of the cable and that the current does not flow on the walls of the casing or the tubing. However, in some instances it may be necessary, in order to meet safety regulations, to ground one side of the transformer. This may result in some minor power delivery inefficiency, since some of the current will flow on the walls of the casing and hence may introduce some eddy currents and some hysteresis and skin effect losses. Alternatively, if a downhole transformer is used to terminate the cable with a balanced primary (neither side grounded) the same effect can be realized even if the one side of the source transformer at the surface is grounded.

The most attractive embodiments involve modifications of existing cables used to supply three-phase power to down hole pump motors. This can be done by reducing the number of conductors to two while at the same time enlarging the diameter of the conductors. A flat armored pump motor cable which normally carries three wires may be modified as follows: First, insulation is removed from the center conductor to permit enlargement of the center conductor, which is used to carry about two-thirds of the return current collected by the exposed casing near the reservoir. The remaining one-third of the return current may be carried on the walls of the casing itself. The two outer conductors in the flat flexible pump motor cable are used to carry the heating current down hole to the electrode. Other versions of flat flexible cable are also possible; they include a triplate line version wherein the center conductor is a flat flexible conductor and the outer conductor is a flat box like conductor, rectangular in form, which completely surrounds the flat inner conductor except for insulation in the intervening space. Armor is used to cover the exterior portions of all cables discussed when required.

A single-phase power source operating in a range of 25 to 1000 Hz is preferred for the present invention in order to take advantage of available commercial equipment. An alternative to the single-phase power source would be a delta-connected three-phase source, which would utilize a three-conductor cable like those used to supply three-phase power to a downhole pump motor. This alternative should have three downhole heating electrodes; at least one electrode and preferably all three are located in the reservoir from which the well derives its output. The spreading resistances between each of the three electrodes may differ significantly, but so long as each conductor of the power delivery cable is terminated on the electrodes (or on the casing immediately above the deposit and/or on the rat-hole casing below the deposit) the net leakage flux in the cable will be essentially zero provided a delta connected source or an ungrounded wye-connected source is used. Thus, the dual concepts of controlling the cable currents to limit leakage flux and terminating the cable conductors in or near the deposit permits implementation of simple, low-cost power delivery systems. A three phase system is advantageous because it is more readily balanced.

Accordingly, the invention relates to an A.C. electrical heating system for heating a fluid reservoir in the vicinity of a mineral fluid well, utilizing A.C. electrical power in a range of 25 to 1000 HZ. The well comprises a borehole extending down through an overburden and through a subterranean fluid (oil) reservoir; the well includes an upper electrically conductive casing extending around the borehole in the overburden, at least one electrically conductive heating electrode located in the reservoir, and an electrically insulating casing between the upper casing and the heating electrode. The heating system comprises an electrical power cable extending down through the conductive upper casing to the heating electrode to supply electrical power to the heating electrode. The electrical power cable comprises at least two electrical conductors, isolated from each other, and an armor sheath of magnetic material emcompassing the conductors, the conductors being electrically terminated at the heating electrode. There is a net vertical current of approximately zero in the conductors so that eddy current and skin effect losses in the armor sheath are minimized.

DESCRIPTION OF THE PREFERRED EMBODIMENTS

Figure 1:
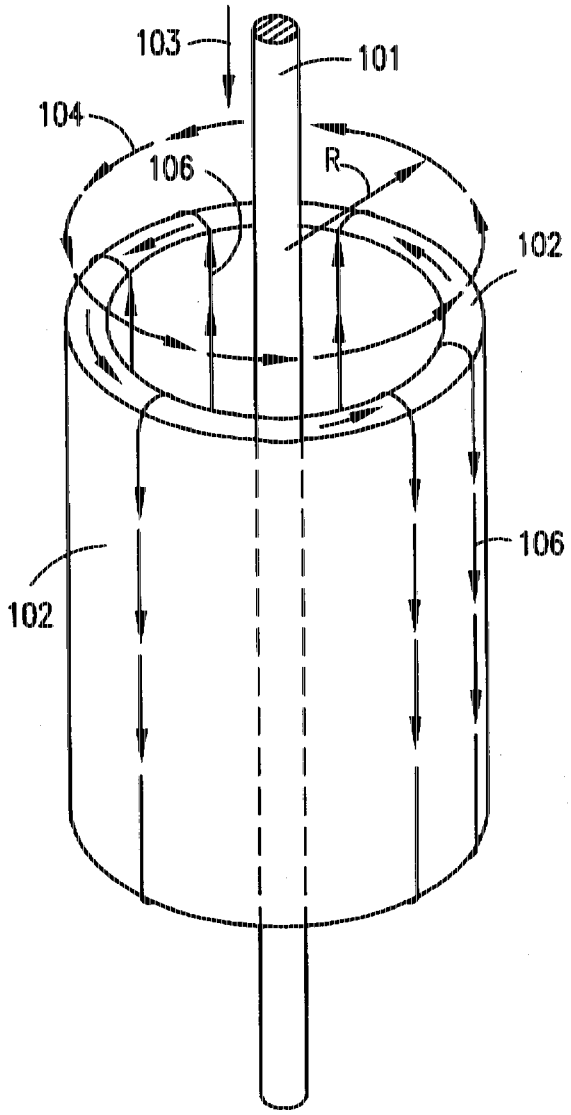
FIG. 1 is an explanatory diagram that shows how eddy current and hysteresis losses are induced in a ferromagnetic casing by a net current flow in one direction.

FIG. 1 illustrates how a conductor 101 with a net AC current flow in the direction of arrow 103 can induce substantial magnetic field intensity 104 in a steel casing 102 or in galvanized steel cable armor. In addition, an eddy current and a skin effect phenomenon may also take place, caused by the circumferential magnetic field 104. The skin effect causes the current to concentrate, as indicated by arrows 106, in thin layers immediately at the surfaces of casing 102. This reduces the cross-sectional area available to carry current. The net effect is increased resistive losses. For steel casing a transformer action current flow 106 is induced such that current flows on both inner and outer surfaces of the casing or armor 102.

Figure 2:
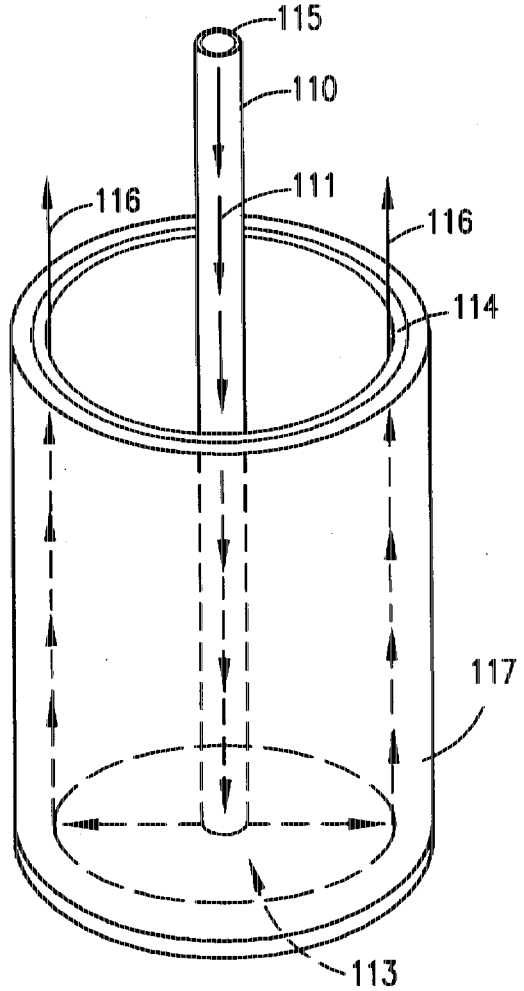
FIG. 2 illustrates, on a conceptual basis, how eddy currents and hysteresis losses are partially reduced by limiting return current flow limited to the inside of the casing.

The eddy current losses which arise from the presence of the circumferential fields in the casing 102 of FIG. 1 can be substantially reduced by causing the return currents to flow only on the inside wall of the casing, as illustrated in FIG. 2. Here the center conductor 110 carries a current as indicated by arrows 111. This current flows downward into a conducting disk 113 which is connected to the conductor 110 and also to the steel casing 117. This conducting disk 113 simulates the current flow path from a monopole electrode through an oil well deposit and back to the lower portion of the well casing 117. In this case the return current, indicated by arrows 116, flows only on the inside surface 114 of the casing. The net current flow on the outside of the casing 117 is zero, since the upwardly flowing current 116 is equal to the downward flowing current 111. Because of eddy currents and resulting skin effect, the current density for conductor 110 is concentrated principally on the surface 115; similarly, on the steel casing 117 the current is concentrated on the inner surface region indicated at 114. Such an arrangement, as illustrated in FIG. 2, can reduce the eddy current and hysteresis losses by a factor of two over that shown for the configuration in FIG. 1.

Figure 3:
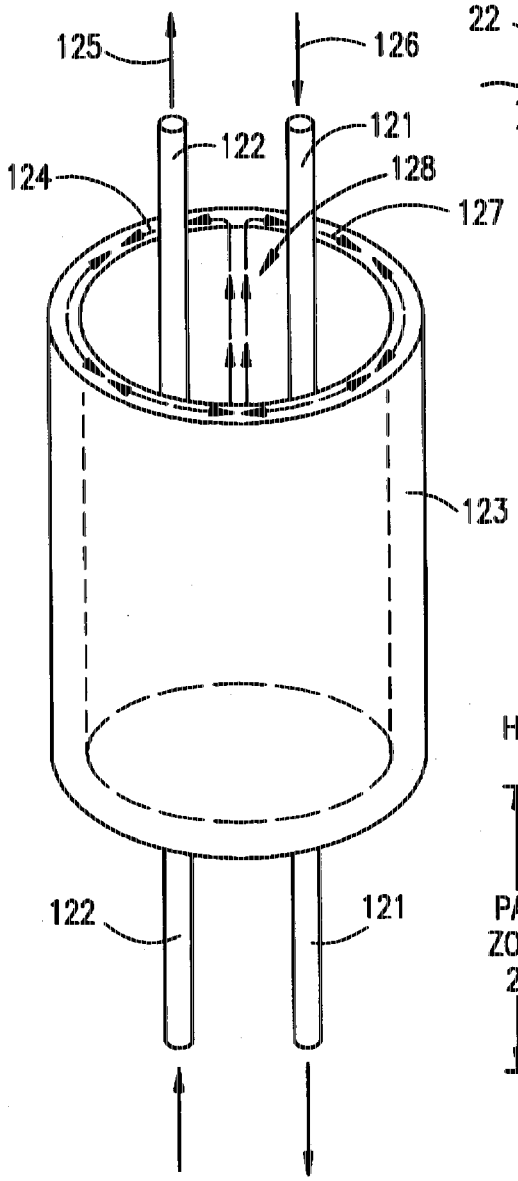
FIG. 3 illustrates, on a conceptual basis, how eddy current and hysteresis loss in a casing can be substantially reduced or eliminated by reducing the net current flow within the casing to zero.

The eddy current and hysteresis losses can be further reduced so that the net current flow for the casing is nearly zero. This concept is illustrated in FIG. 3; a conductor 122 carries the upward AC current, indicated by arrow 125, and a conductor 121 carries the downward flowing AC current 126. Both of these conductors are in the steel casing 123. The upward-flowing current 125 produces a net flux 124 in the casing, whereas the down-going current 126 produces a flux 127 in the opposite direction. As a result, the magnitude of the flux is greatly reduced; it is further reduced because the flux is forced to flow through the air gap or space 128 between wires 122 and 121. This air gap, because it has a relative permeability of only one, greatly reduces the amount of flux which otherwise would flow through the casing itself.

Figure 10:
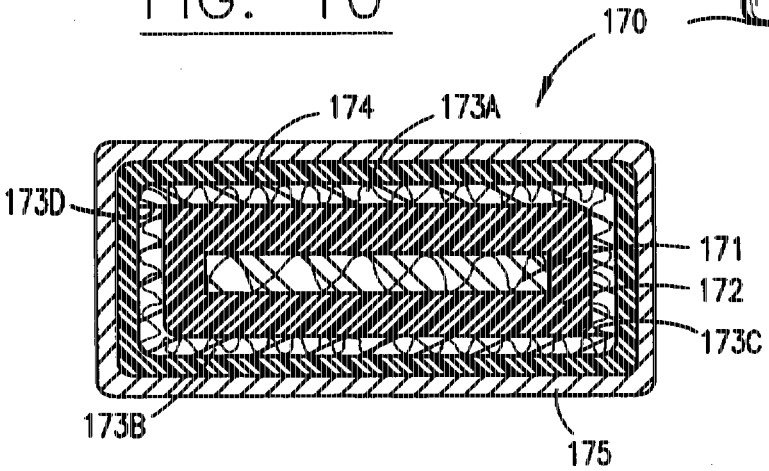
FIG. 10 illustrates a flat triplate conductor cable configuration which would be reasonably flexible and yet would not exhibit significant external fields outside of the outer conductor.

Other arrangements are possible to further reduce the flux. For example, conductor 122 could be formed as a thin cylinder forming an envelope around conductor 121. Under such circumstances, the net current just outside the envelope of the cylindrical conductor would be zero. An example of this is illustrated in FIG. 10, described hereinafter.

Figure 8:
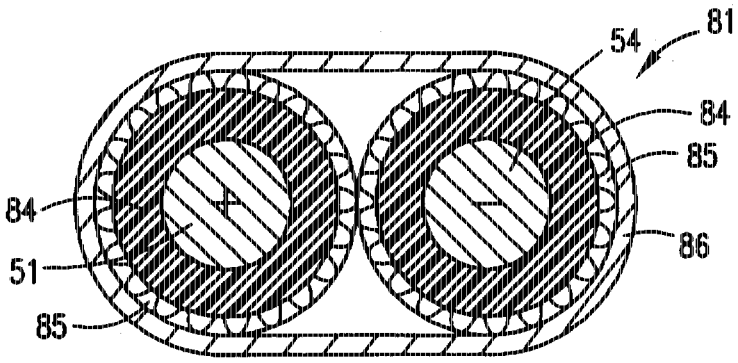
FIG. 8 is a cross-section view of a modified pump motor cable wherein the number of conductors has been reduced from three to two while at the same time increasing the size of the two remaining conductors.
Figure 9:
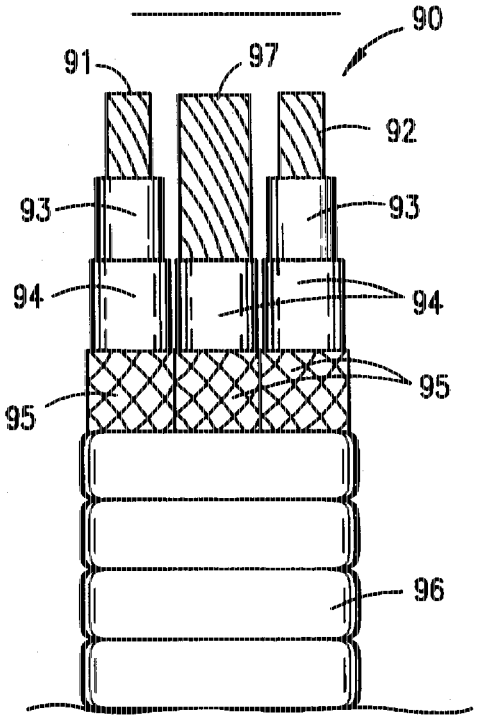
FIG. 9 illustrates a possible modification of a three conductor pump motor cable, with insulation removed from the center conductor and the available space taken up by an enlarged center conductor.

Various embodiments are possible using the aforementioned concept. These are illustrated in succeeding figures showing preferred embodiments used to deliver electrical heating power downhole via an armored cable. This armored cable has characteristics such that the net flux or leakage flux which is created by the cable is small or nonexistent. Such cables are illustrated in FIGS. 8, 9 and 10.

Figure 4:
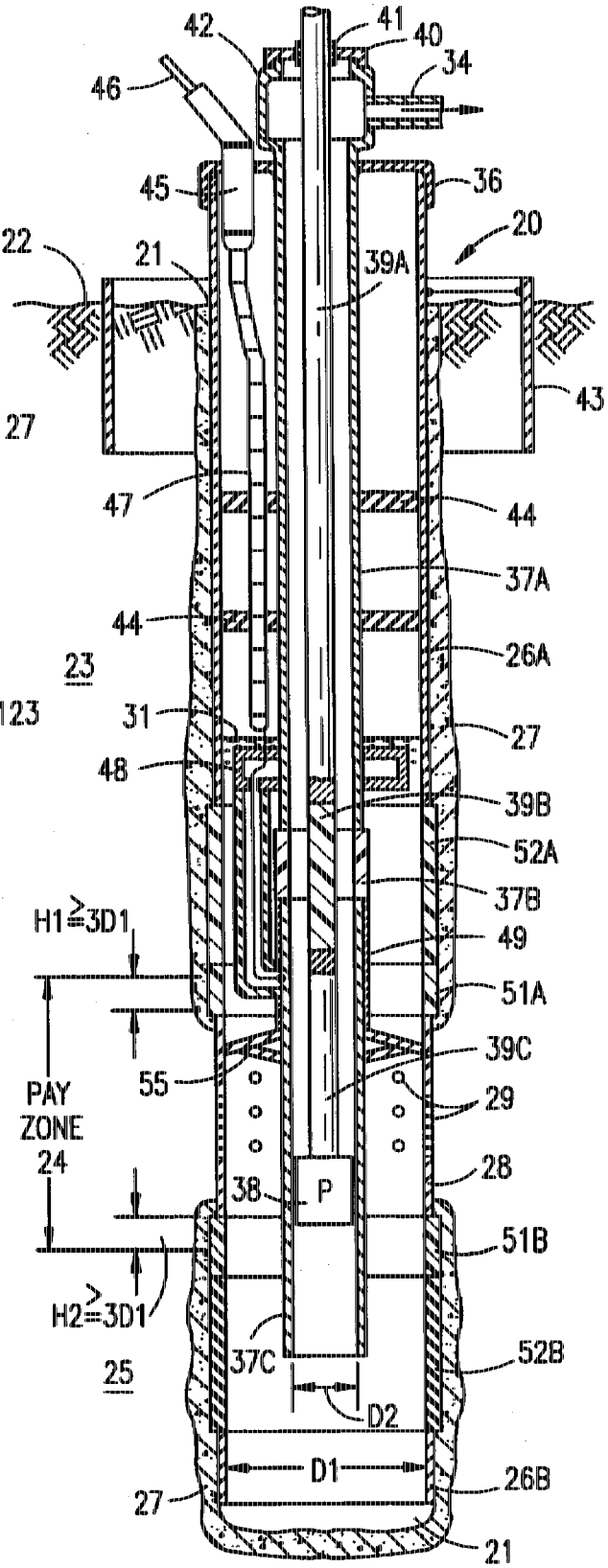
FIG. 4 is a conceptual vertical section view of an oil well which embodies a preferred power delivery system according to the present invention.

FIG. 4 illustrates a liquid mineral well 20, usually an oil well, equipped with an electrical heating system comprising a grounded or "cool" wellhead. Well 20 comprises a well bore 21 extending downwardly from a surface 22 through an extensive overburden 23 that may include a variety of different formations. Bore 21 of well 20 continues downwardly through a mineral (oil) deposit or "pay zone" 24 and into an underburden 25. Well 20 is utilized to draw a mineral fluid, in this instance petroleum, from the deposit 24, and to pump that fluid up to surface 22.

An electrically conductive metal (steel) casing comprising an upper section 26A and a lower section 26B lines a major part of well bore 21. The upper casing section 26A extends downwardly from surface 22. Cement 27 may be provided around the outside of the well casing. In well 20, the lower casing section 26B is shown as projecting down almost to the bottom of well bore 21; a limited portion of the well bore may extend beyond the bottom of casing section 26B. In FIG. 4 it will be recognized that all vertical dimensions are greatly foreshortened.

Between the two well casing sections 26A and 26B, in alignment with pay zone 24, there is a cylindrical conductive heating electrode 28 that may be formed as a multi-perforate section of the same metal casing pipe as sections 26A and 26B. The perforations or apertures 29 (electrode 28 may be a screen) admit the mineral fluid (petroleum) from deposit 24 into the interior of the well casing. Apertures 29 may be small enough to block entry of sand into the well. Petroleum may accumulate within the well casing, up to a level well above deposit 24, as indicated at 31. Level 31 may be as much as 500 to 800 meters above the top of pay zone 24, depending on the pressure of the liquid in the deposit 24. Casing sections 26A and 26B may be made of conventional carbon steel pipe with an internal diameter D1 of about 7 inches (18 cm); the same kind of pipe can be used for the heating electrode 28. At the top of well 20, the casing section 26A is covered by a wellhead cap 36.

Well 20, FIG. 4, further comprises an elongated production tubing, including three successive tubing portions 37A, 37B and 37C that extend downwardly within well 20. The bottom tubing portion 37C encompasses a pump 38 and projects down below pay zone 24. The upper and lower portions 37A and 37C of the production tubing are conductive metal pipe; the intermediate section 37B is non-conductive, both electrically and thermally. Resin pipe reinforced with glass fibers or other fibers can be used for portion 37B of the production tubing; such tubing of fiber reinforced plastic (FRP) is available with adequate strength and non-conductivity characteristics. Sections 37A, 37B and 37C of the production tubing are shown as abutting each other; interconnections are not illustrated. It will be recognized that appropriate couplings must be provided to join these tubing sections. Conventional threaded connections can be employed, or flanged connections may be used.

From the top of well 20 a pump rod or plunger 39A projects downwardly into production tubing 37A through a bushing or packing element 41 in a wellhead cap 40 that terminates tubing 37A. Rod 39A may be mechanically connected, by an electrical and thermal insulator rod section 39B and a lower pump rod section 39C, to the conventional pumping mechanism generally indicated at 38. In some systems the isolator rod section 39B may be unnecessary.

In the preferred construction for well 20, production tubing sections 37A and 37C may be conventional carbon steel tubing. In a typical well, the production tubing 37A–37C may have an inside diameter of approximately two inches (five cm) or more. The overall length of the production tubing, of course, is dependent upon the depth of well bore 21 and is subject to wide variation. Thus, the total length for tubing 37A–37C may be as short as 200 meters or it may be 1500 meters, 3000 meters, or even longer.

At the top of well 20 (FIG. 4) there is a surface casing 43 that encompasses but is spaced from the upper casing section 26A. Surface casing 43 is usually ordinary steel pipe. It extends down into overburden 23 from surface 22 and affords a surface water barrier and an electrical ground for the well. A fluid outlet conduit 34 extends away from an enlarged wellhead chamber 42 at the top of the production tubing; conduit 34 is used to convey oil from well 20 to storage or to a liquid transport system. In well 20, a series of annular mechanical spacers 44 position the production tubing section 37A approximately coaxially within the well section casing 26A, maintaining the two in spaced relation to each other. However, the annular spacer members 44 should not afford a fluid tight seal at any point; rather, they should allow gas to pass upwardly through the well casing, around the outside of the tubing 37, so that the gas can be drawn off at the top of the well. Similar spacers or "centralizers" (not shown) are preferably provided farther down in well 20. In some systems spacers 44 are electrical insulators; in others, spacers 44 are of metal. The choice depends on what parts of well 20 require heating.

As thus far described, apart from the insulating sections and electrode structures described more fully hereinafter, well 20 is essentially conventional in construction. Its operation will be readily understood by those persons involved in the mineral well art, whether the well is used to produce liquid petroleum, natural gas, or some other mineral fluid. Well 20, however, is equipped with an electrical heating system, and features of that heating system, particularly the cable used to deliver electrical power downhole, are the subject of the present invention.

The well heating system illustrated in FIG. 4 includes an electrical power source (not shown), preferably an alternating current source including a transformer having an ungrounded secondary, that is connected to the well 20 by an external dual conductor power cable 46 and a wellhead dual conductor power feedthrough 45 (FIG. 4). Members 34, 36, 37A, 43 and the outer shell of feed through 45 are all maintained in effective electrical contact with each other, and all are effectively grounded. Thus, the wellhead or superstructure members for well 20 are all electrically grounded and present no electrical danger to workmen or others at the well site. Well 20 has a "cool" wellhead.

Figure 5:
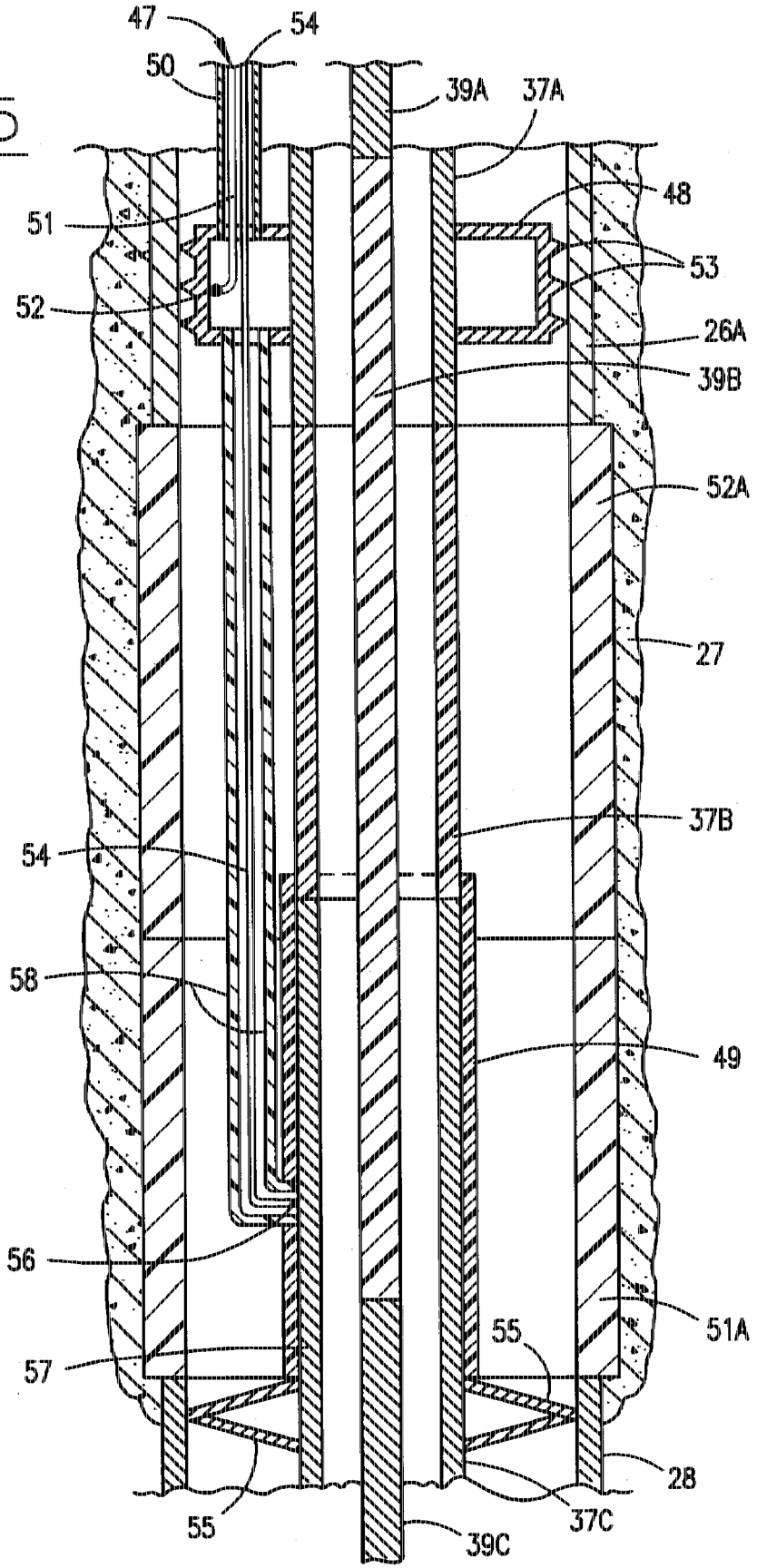
FIG. 5 is an enlarged view of a portion of FIG. 4 constituting a vertical cross-section view showing how the two conductors of a preferred cable are terminated down hole to realize the suppression of eddy current and hysteresis losses.

The electrical heating system for well 20 (FIG. 4) includes an internal dual conductor electrical power cable 47 that extends down through the upper section 26A of the well casing. The upper end of power cable 47 is connected to external cable 46 through the electrical power feedthrough device 45. The lower end of power cable 47 extends to a connector subassembly 48 that electrically terminates the conductors of cable 47, connecting one cable conductor electrically to the lower conductive portion of production casing 26A. In the portion of well 20 that is illustrated in FIG. 5 the electrical connector subassembly 48 is located near the top boundary of the deposit or pay zone for the well. As shown in FIG. 5, the dual conductors of cable 47 are externally insulated and armored at 50. One conductor 51 is attached to the connector assembly 48 at 52; assembly 48 in turn is connected to the steel casing 26A via conductive teeth 53. The remaining conductor 54 is carried in an insulated tube 58 to a connection 56 on a contactor pipe 57 that is a part of the lower section 37C of the production tubing of the well. Contactor pipe 57 is connected to a contactor 55 which electrically connects to conductor 54 via a contact 56 and the contactor pipe 57.

In the section between the connector assembly 48 and the contactor 55, FIGS. 4 and 5, an insulated pump rod 39B is employed which is physically attached to the metallic pump rod sections 39A and 39C. Also in this region, a non-conducting section 52A of fiber reinforced plastic (FRP) is inserted between the upper casing 26A and the heating electrode 28 of the well. Similarly, a non-conducting section of FRP tubing 37B is used between the two conducting sections of tubing 37A and 37C. Electrical insulation 49 is used to cover the conducting metallic portion of the tubing 37C above contactor 55.

Referring to FIG. 4 again, the electrical heating system of well 20, to operate efficiently, must isolate the pay zone components, particularly electrode 28 and production tubing section 37C, from other components of the well structure. This also usually applies to the lower pump rod section 39C. In part, the electrical isolation required has already been described, including the central production tubing portion 37B and the insulation 49 on the upper portion of production tubing portion 37C. As previously noted, there is an insulator/isolator section 39B in the pump rod. Tubing portion 37B and rod section 39B each should have a minimum height of one meter; a height of more than three meters is preferred. Isolation of the upper and lower sections 26A and 26B of the well casing from the heating electrode 28 is, if anything, even more important.

There is a high temperature insulator cylinder 51A mounted on the top of electrode 28; see FIGS. 4 and 5. Cylinder 51A should have a minimum height of one meter; a height of over three meters is preferred. Immediately above cylinder 51A there is the additional thermally and electrically non-conductive insulator cylinder 52A, which should be much longer than cylinder 51A. These two cylinders 51A and 52A have internal diameters approximately the same as the casing diameter D1 (FIG. 4) which, if needed, is also the approximate internal diameter of electrode 28, comprising a high temperature insulator cylinder 51B that is extended much further by the additional non-conductive cylinder 52B. Members 51B and 52B can be of unitary construction, as can isolator cylinders 51A and 52A in the well rathole (FIG. 4). They are shown as having two-piece construction because high temperature resistance is essential immediately adjacent the main heating electrode 28 but is not so critical farther away; different resins may be desirable for cost reasons.

The top of electrode 28 should be located below the top of pay zone 24; that is, the upper rim of electrode 28 (or bottom of insulator 51A) should be positioned so that it is at least three diameters down into the pay zone. Thus, as indicated in FIG. 4, H1 should be at least equal to and preferably considerably greater than 3D1. Similarly, the bottom of electrode 28 should be above the bottom of the pay zone 24, so that H2 is at least three times D1 and preferably more.

Figure 6:
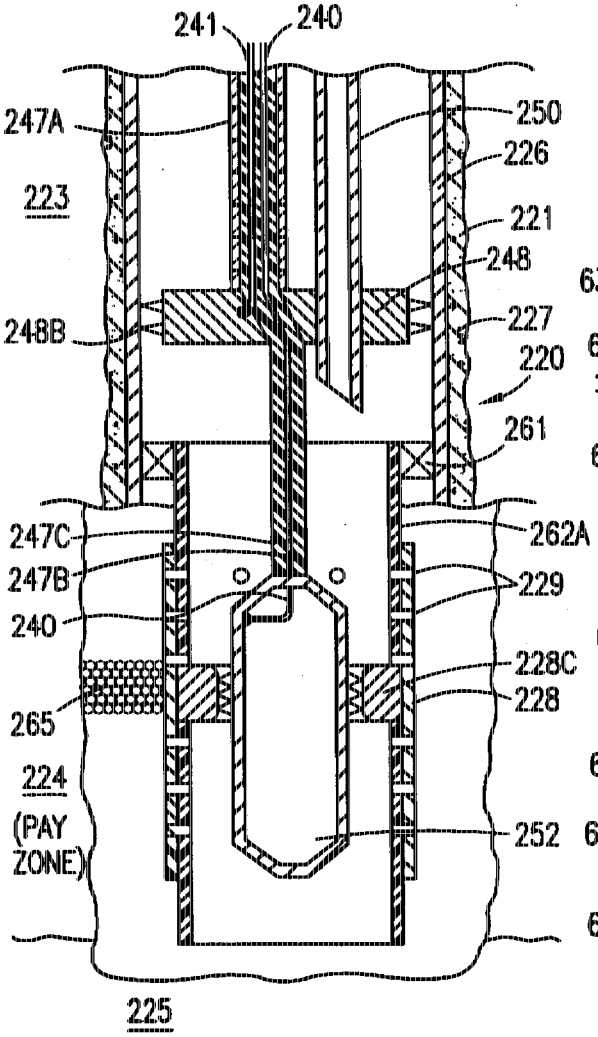
FIG. 6 illustrates the details of an open hole completion that realizes the benefits of the low leakage flux cables.

FIG. 6 shows the lower section of an "open hole" well 220. A borehole 221 is initially drilled through the overburden 223 to about the top of the producing formation of interest, the "pay zone" 224. A production casing 226 is conventionally set in the borehole 221, with cement 227. The borehole is then drilled down further, through the deposit 224 and beyond, into the underburden 225, usually at an enlarged diameter. During the extension of the borehole, high density "mud" is utilized to preclude inward collapse of the borehole. The weight of the mud is adjusted to prevent ingress of reservoir fluids into the borehole and to prevent collapse of the borehole in the incompetent portion of the target reservoir, the pay zone 224.

The next step is to introduce a conductive contactor 252, which makes electrical contact to the contact cylinder or collector 228C of a heating electrode 228. The contact cylinder 252 is connected to one conductor 240 of a power cable 247B which is housed in a fiberglass or other insulated cable container shown as an FRP pipe 247C. The cable container 247C also supports the cable section 247B, from a cable connector subassembly 248 anchored in casing 226, and terminates the insulated cable contained in 247C. The cable connector assembly 248 also provides an electrical termination for the production tubing 250 of the well. A dual conductor cable 247A, preferably an armored cable, goes upwardly in well 220, above the cable connector assembly 248. The second conductor 241 of cable 247A is terminated at the cable connector assembly 248, which is electrically connected to the casing 226.

Not shown in FIG. 6 is a pump, which may be located either above or just below the connector assembly 248. The assembly 248 also serves as a tubing anchor with anchor teeth 248B providing the contact. Also, passageways around this anchor, between the teeth 248B, allow fluids to pass upwardly as needed.

Figure 7:
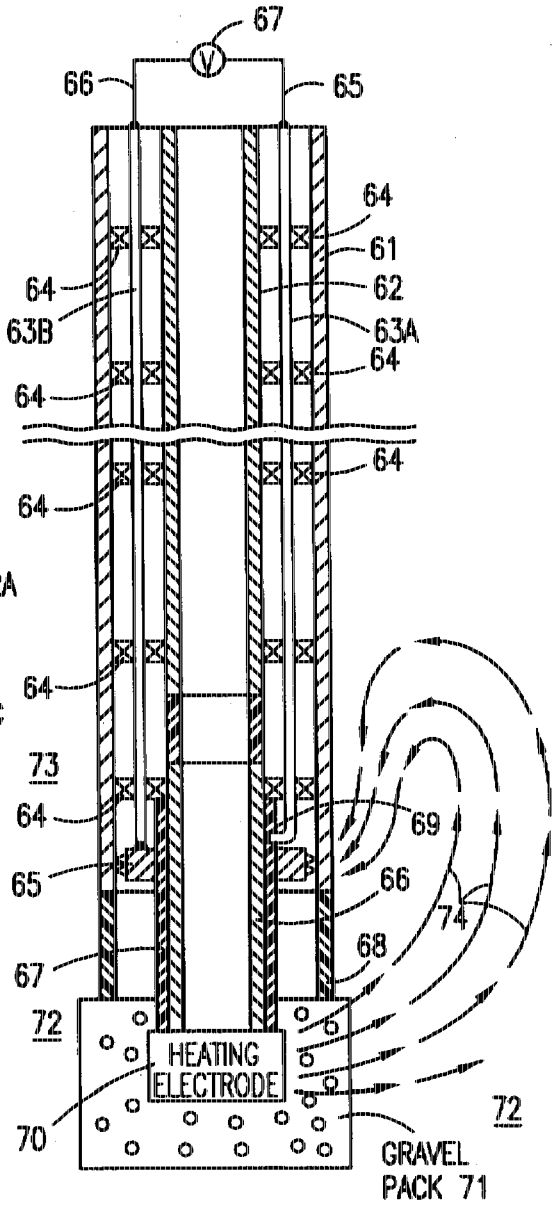
FIG. 7 illustrates an alternative method to deliver power by two conductors spaced between the tubing and the casing.

FIG. 7 illustrates an alternate system for delivering power down hole for an open hole completion. In FIG. 7 electrical power is delivered by a pair of conductors 63A and 63B, each of which is located between the well casing 61 and the production tubing 62. These conductors are located opposite each other symmetrically between the walls of the well casing 61 and the production tubing 62. The casing 61 and tubing 62, both of steel pipe, are each spaced from the conductors 63A and 63B by a plurality of insulated spacers 64. The wellhead arrangement is not shown in FIG. 7. Power is supplied from a generator 67 via a cable 65 connected to conductor 63A, and current is returned to the generator 67 via a conductor 63B and a cable 66. In such an arrangement the conductor 63A could be grounded to the casing just above the deposit tapped by the well. The other conductor 63B is connected to the heating electrode 70 of the well.

The lower part of the well of FIG. 7 is completed similarly to those described for FIGS. 5 and 6. A connector assembly block 65 terminates conductor 63B. This assembly 65 also provides the physical strength to hold the production tubing 62 and the conductors in tension as well as providing electrical contact between the casing 61 and the conductor 63B. Conductor 63A terminates, at a contact 69, to a lower tubing section 66 which is electrically insulated by an insulation layer 67 from the bore hole fluids and from the connector assembly block 65. The lowest section of the well casing is an insulating section 68. Current flows downwardly on conductor 63A through the lower tubing 66 to the perforated heating electrode 70, then through a gravel pack 71, outwardly into the deposit 72, though the overburden 73 and back to the production casing 61, through the connector assembly 65 and finally to the surface via conductor 63B. The current flow patterns through the earth are illustrated by arrows 74. The arrangement shown in FIG. 7 is designed to allow greater current flow into the deposit than would be possible using an armored cable.

An alternative arrangement would be to drive both conductors 63A and 63B at the same potential and collect the return current from the casing of the well, and possibly also through the tubing of the well.

FIG. 8 illustrates a two-conductor cable 81 like the cable conventionally used to supply power to a downhole pump motor. The two-conductor cable 81, however, is modified for use in the electrical heating system of the invention. In cable 81 heating current enters a conductor 51 and return current is received on a conductor 54, or vice versa. The conductors 51 and 54 are insulated from each other by insulation sheaths 84, such as ethylene polypylene diene monomen (EPDM) insulation. Both insulated conductors are covered by plastic braid sheaths 85. The overlaid braided combination is covered by metallic armor 86, preferably of magnetic steel. Conductors 51 and 54 are shown as solid conductors, but each may comprise a group of conductive wires.

FIG. 9 illustrates how a three conductor pump motor cable can be modified for use as a dual conductor cable 90 that functions in the low leakage flux mode of the present invention. 91 and 92 are the Standard No. 1 wire gauge conductors usually found in a conventional three-phase pump motor cable. These two groups of conductors are each covered by insulation 93; EPDM insulation is appropriate. Insulator sheaths 93 are each, in turn, covered by a fatigue-resistant lead sheath 94 and an oil-resistant synthetic resin braid 95. The whole assembly is covered by a preformed steel armor 96. Steel tape may be used. The center conductor 97 of cable 90 is enlarged by eliminating the insulation 93 used on conductors 91 and 92. Ideally, it would be desirable that the cross-sectional area of the central/conductor 97 equal the combined cross-sectional areas of 91 and 92. However, a cross-section of as low as 40% for conductor 97 may be usable in installations where part of the return current is carried by the well casing. In this case one side of the power source would be grounded to the casing, at the wellhead. To be most efficient, the well casing is preferably conventional steel pipe seven inches (18 cm) in diameter and the well should have a depth of about 600 meters or less when cable 90 is used.

FIG. 10 illustrates another approach to obtaining a low flux leakage cable. This is a triplate line 170 that consists of three basic conductive plates. There are two outer flat flexible plates or conductors 173A and 173B which may partially encompass as separate plates or may be interconnected to completely surround an inner flat flexible plate 171. The inner plate 171 is preferably formed by a flattened braid of copper and this is surrounded by the two similar outer braided conductive plates 173A and 173B. Braided plates 173A and 173B may be interconnected by additional conductors (not shown) at the corners 173C and 173D. The inner conductor 171 is separated from the outer conductors 173A and 173B by appropriate insulation 172, which may be EPDM insulation. A protective non-conductive plastic braid 174 is wrapped around the conductor-insulation combination, which is then covered by a conductive armor wrap or sheath 175. Other layers may be used if the cable 170 remains adequately flexible. The net magnetic flux in the armor wrap 175 is zero, since the current flowing downwardly in conductor 171 is cancelled by the current flowing upwardly in conductor 173A, 173B, and vice versa. The flat rectangular form of FIG. 10 is preferred over other conductor configurations, such as circular conductors, simply because the cable 170 can be coiled more readily.

Other cable configurations are possible to achieve the aforementioned benefits. The first is based on the fact that within any annular or tubular arrangement of ferromagnetic material, the net current flow (the difference between essentially upward flowing current and downward flowing current) is substantially less than the sum of the magnitude of the upward and downward current flow. In ideal arrangements, the net vertical current flow should be nearly zero. Assuming equal upward and downward current flow, a net current equal to one-fourth of twice the current in one wire, or equal to one-half the one-wire current, might be acceptable for a 60 Hz frequency seven inch (18 cm) casing, a depth not exceeding 1000 meters, for a #1 wire size in the outer conductors of a cable similar to that shown in FIG. 9, for an effective spreading resistance in the reservoir of the order of one ohm or more, and for downhole heating of the order of 50 to 100 kilowatts. The use of lower frequencies, smaller net currents, higher spreading resistances, and/or larger steel casing would permit operation at greater depths or higher power.

Assuming an ungrounded transformer supply at the surface, the other criterion is that both of the conductors of the dual conductor power delivery system should be properly terminated downhole. This means that a minimum electrical isolation means must be provided downhole, below where one of the dual conductors contacts the production casing, at a location somewhat above the deposit and the other terminals on the electrode. In addition, if some small net current flow can be tolerated the transformer or other source on the surface should be connected to the casing or grounded. Preferably, an ungrounded or balanced primary of a downhole transformer can be used to realize zero net current flow.

Figure 11:
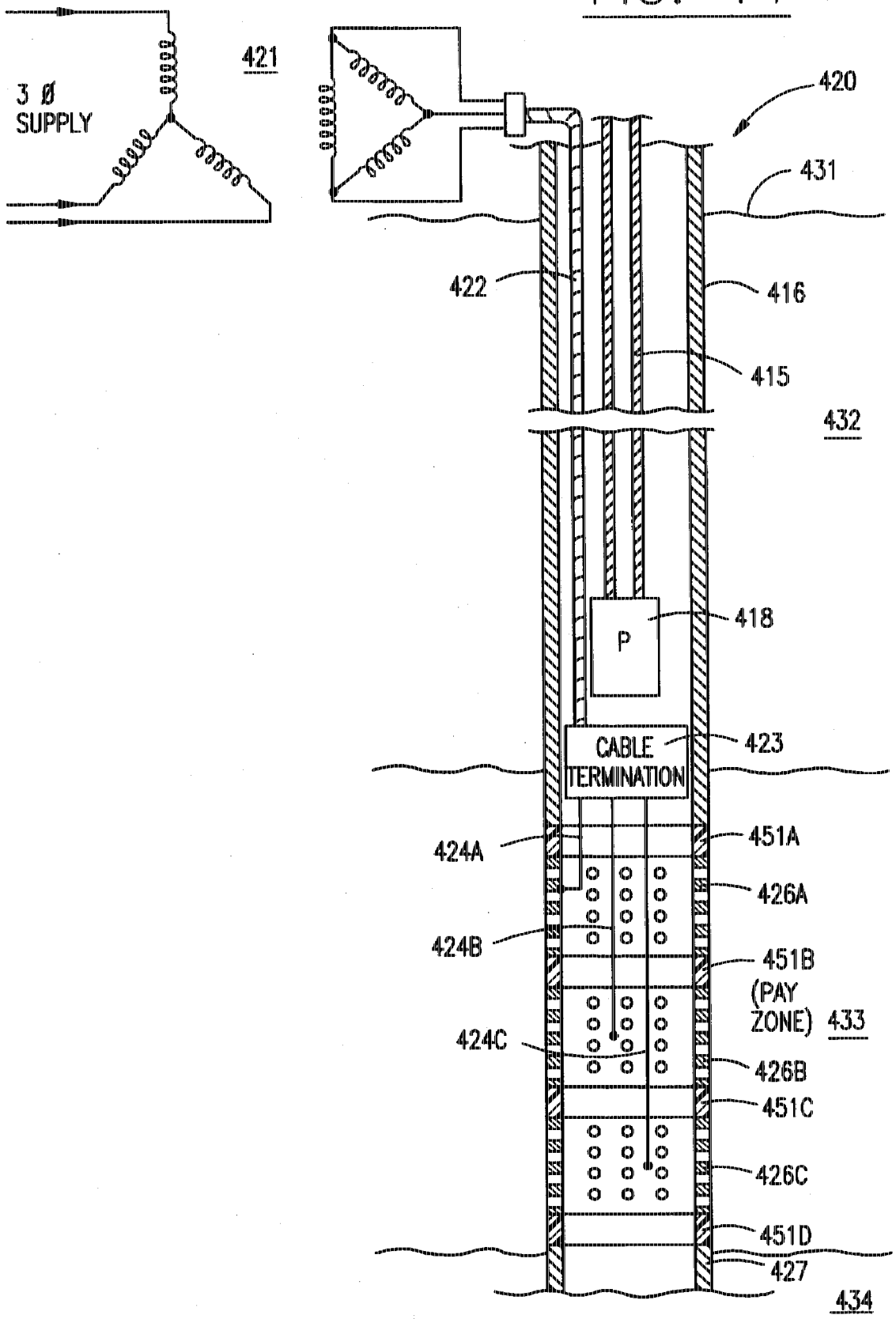
FIG. 11 illustrates the use of an ungrounded transformer at the surface with three downhole electrodes.

FIG. 11 illustrates a heating system in a well 420 in which a three-phase wye-delta above ground transformer 421 supplies electrical heating power at 60 Hz (or 50 Hz) to an armored three conductor cable 422 that carries the electrical power downhole to a cable termination 423. Cable 422 may have the construction shown for cable 90 in FIG. 9, except that the three conductors in the cable 422 preferably all have the same cross-sectional area. From cable termination 423 there are three insulated conductors 424A, 424B and 424C that afford electrical power connections to three heating electrodes 426A, 426B and 426C, respectively. Each of these electrodes is a multiperforate section of conductive well casing; the electrodes are electrically isolated from each other and from the main well casing 416 and the rathole casing 427 of well 420 by a series of electrical and thermal insulator casing sections 451A, 451B, 451C and 451D. Well 420 is also shown as including production tubing 415 connected to a downhole pump 418. As in previous figures, well 420 extends down from the ground surface 431 through overburden 432 and the deposit or "pay zone" 433 into underburden 434. In the system shown in FIG. 11 neither the primary nor the secondary of transformer is grounded.

In most of the foregoing specification it has been assumed that commercially available A.C. power has a frequency of 60 Hz. It will be recognized that the basic considerations affecting the invention apply, with little change, where the available power frequency is 50 Hz.

Other variations and uses are possible. For example, as described in my co-pending application Ser. No. 08/396,620, filed concurrently with the parent of this application, now the U.S. Pat. No. 5,621,844 the downhole cable should be terminated with a balanced load, such as by the primary windings of a downhole transformer. The voltage source that supplies the cable may be balanced and ungrounded, as in FIG. 11. Alternatively, one or more windings (for a multiphase transformer) of the source may be earthed (grounded) for electrical safety purposes.

Figure 12:
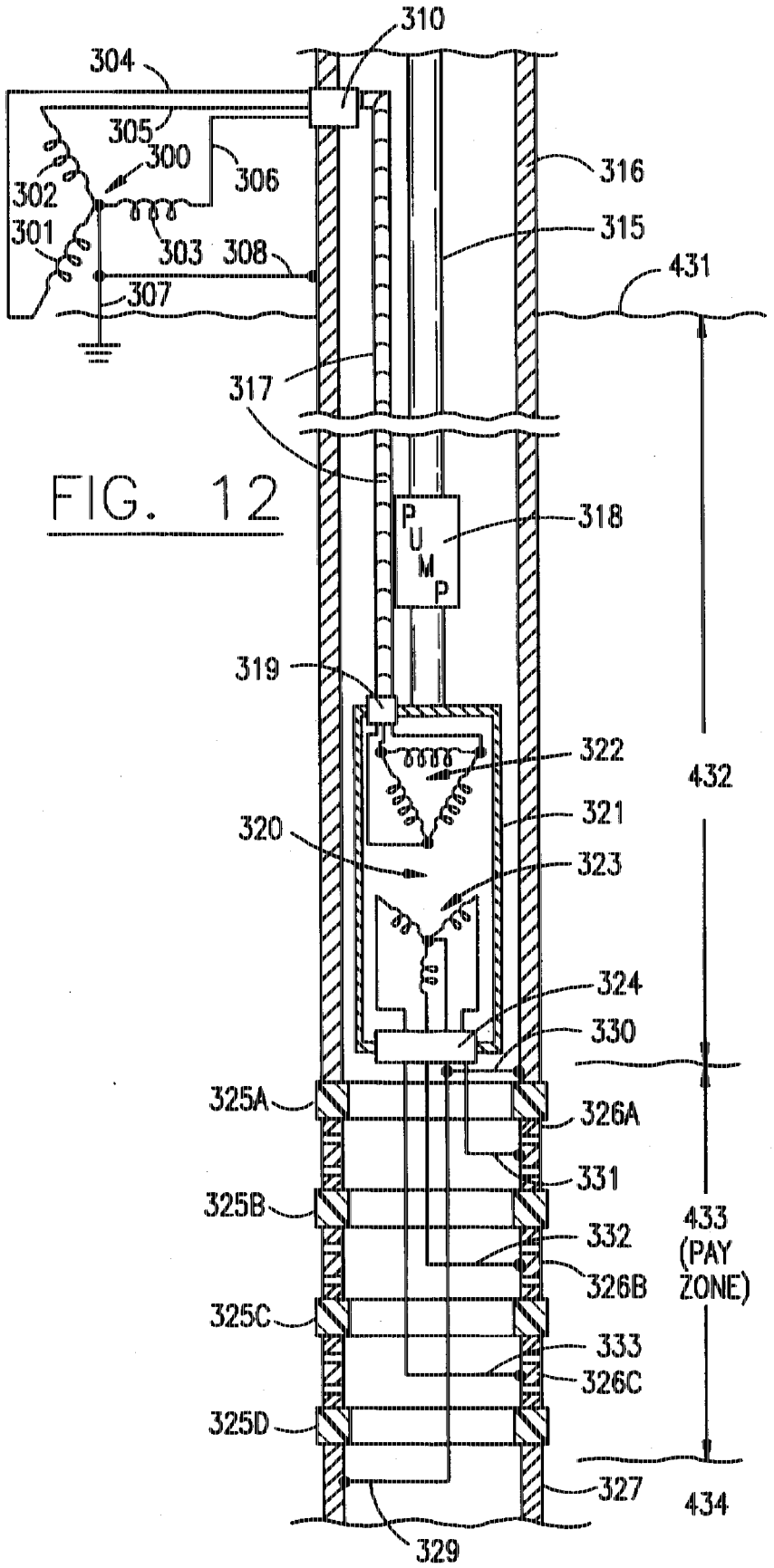
FIG. 12 illustrates the use of a grounded transformer at the surface supplying power to a downhole transformer having an ungrounded primary.

Such an arrangement is shown in FIG. 12. FIG. 12 is a partially schematic cross-section of a portion of an oil well extending downwardly from the surface 431 of the earth, through the overburden 432 and the pay zone (deposit or reservoir) 433 and into the underburden 434. The well of FIG. 12 is completed using multiple heating electrodes 326A, 326B, 326C; the electrodes are all located in the deposit 433. In addition, the conductive casing 316 in the overburden 432 and the lower section of conductive casing 327 in the underburden 434 are also connected to the neutral of the wye-connected secondary output winding 323 of a delta-wye downhole transformer 320. The output windings are connected, via a connector 324, to the preforated electrode segments 326A, 226B and 326C of the casing by insulated cables 331, 332, and 333 respectively. The neutral of the wye output windings 323 is connected to casing sections 316 and 327 by insulated cables 330 and 329. The electrodes 326A–326C are isolated from one another from and adjacent the casing sections by insulating casing sections 325A through 325D.

Power is for the system of FIG. 12 supplied to the well head by a wye-connected three phase transformer 300; only the secondary windings 301, 302 and 303 of power transformer 300 are shown. The neutral 307 of the transformer secondary is connected to an earthed ground and is also connected to the casing 316 by a conductor 308. Three-phase power is supplied, through the connector 310 in the wall of the casing 216 at the well head, by three insulated cables 304, 305, and 306. Power is delivered down hole via an armored cable 317 which is terminated in a connector 319. Cable 317 may employ the construction shown in FIG. 9 except that all conductors in the cable should have the same size. The connector then carries the three phase current through the wall of a downhole transformer container 321 and thence to the delta connected transformer primary 322. Liquids from the well are produced by a pump 318 that impels the liquids up through the production tubing 315.

The advantage of the downhole transformer configuration shown in FIG. 12 is that there is no net current flowing in the cable 317 (the upward flowing components of the current, at any time, are equal to the downward flowing components). The result is that the magnetic leakage fields are suppressed. This is a consequence of the balanced or delta termination afforded by primary 322 in transformer 320; current pathways either on the casing 316 or the tubing 315 are not used.

While three phase 60 Hz power may be used in the system illustrated in FIG. 12, the design of the electrodes 326A–326C and their emplacement in the deposit, pay zone 433, must be carefully considered to avoid massive three-phase power line imbalances. Such imbalances lead to under utilization of the power carrying capacity of the armored cable 317 and can require additional equipment above ground to cope with any such three-phase power line imbalances.

Other types of downhole passive transformation of power are possible. For example, at power frequencies higher than 400 Hz, resonant matching may be possible by means of passive downhole networks comprised of inductors and capacitors. Thus, rather than the classical transformer with a winding around a ferromagnetic core, a series inductor and shunt capacitor could be employed downhole.

I claim:

1. An electrical power cable for supplying downhole electrical heating power in an A.C. electrical heating system for heating a fluid reservoir in the vicinity of a mineral fluid well, utilizing A.C. electrical power in a range of 25 to 1000 Hz, the well comprising a borehole extending down through an overburden and through a subterranean fluid reservoir, the well including an electrically conductive upper casing extending around the borehole in the overburden, at least one electrically conductive heating electrode located in the reservoir, and an electrically insulating casing between the upper casing and the heating electrode, the electrical power cable extending down through the conductive upper casing to the heating electrode to supply electrical power to the heating electrode, the electrical power cable comprising three electrical conductors, electrically isolated from each other, and an armor sheath of magnetic material encompassing the conductors, the conductors being electrically terminated within a zone that immediately surrounds the heating electrode and adjacent formations, with a net vertical current of approximately zero in the conductors so that eddy current and skin effect losses in the armor sheath are minimized.

2. An electrical power cable for supplying downhole electrical heating power in an electrical heating system for a mineral fluid well, according to claim 1 in which the three electrical conductors are all of approximately the same cross-sectional area.

3. An electrical power cable for supplying downhole electrical heating power in an electrical heating system for a mineral fluid well, according to claim 1, in which two of the electrical conductors each have a first cross-sectional area and the third electrical conductor has a cross sectional area substantially larger than the first cross-sectional area.

4. An electrical power cable for supplying downhole electrical heating power in an electrical heating system for a mineral fluid well, according to claim 3 in which:

the third electrical conductor is of rectangular cross-sectional configuration;

the two electrical conductors are located on opposite sides of the third electrical conductor; and the cable further comprises electrical insulation interposed between the two electrical conductors and the third electrical conductor to electrically isolate each of the two electrical conductors from the third electrical conductor.

5. An electrical power cable for supplying downhole electrical heating power in an electrical hating system for a mineral fluid well, according to claim 4 in which each of the two electrical conductors is of L-shaped cross-sectional configuration.

6. An electrical power cable for supplying downhole electrical heating power in an A.C. electrical heating system for heating a fluid reservoir in the vicinity of a mineral fluid well, utilizing A.C. electrical power in a range of 25 to 1000 Hz, the well comprising a borehole extending down from the surface through an overburden and through a subterranean fluid reservoir, the well including an electrically conductive upper casing extending around the borehole in the overburden, an electrically conductive heating electrode located in the reservoir, the heating electrode having a length smaller than the depth of the reservoir, and an electrically insulating casing between the upper casing and the heating electrode, the electrical power cable extending down through the conductive upper casing to the heating electrode to supply electrical power to the heating electrode, the electrical power cable comprising: at least two electrical conductors of approximately equal cross-sectional area each encompassed by an insulator sheath so that the two conductors are electrically isolated from each other, and an armor sheath of magnetic steel encompassing the conductors, the conductors being electrically terminated within a zone that immediately surrounds the heating electrode and adjacent formations, with one conductor connected to and terminated at the heating electrode in the reservoir and the other conductor electrically connected to and terminated at the upper casing immediately above the reservoir, and with a total net vertical current in the conductors of approximately zero so that eddy current and skin effect losses in the armor sheath are minimized, none of the conductors being grounded at the surface.

* * * * *